US011939130B2

(12) United States Patent
Fu et al.

(10) Patent No.: US 11,939,130 B2
(45) Date of Patent: Mar. 26, 2024

(54) PACKAGE ASSEMBLY FOR PACKAGING OBJECTS

(71) Applicant: ZHEJIANG DAHUA TECHNOLOGY CO., LTD., Zhejiang (CN)

(72) Inventors: Qiujia Fu, Hangzhou (CN); Yikun Liang, Hangzhou (CN)

(73) Assignee: ZHEJIANG DAHUA TECHNOLOGY CO., LTD., Hangzhou (CN)

( * ) Notice: Subject to any disclaimer, the term of this patent is extended or adjusted under 35 U.S.C. 154(b) by 27 days.

(21) Appl. No.: 17/653,654

(22) Filed: Mar. 6, 2022

(65) Prior Publication Data

US 2022/0185563 A1 Jun. 16, 2022

Related U.S. Application Data

(63) Continuation of application No. PCT/CN2020/117765, filed on Sep. 25, 2020.

(30) Foreign Application Priority Data

| | | |
|---|---|---|
| Sep. 30, 2019 | (CN) | 201921665588.7 |
| Apr. 16, 2020 | (CN) | 202010298301.2 |
| Apr. 16, 2020 | (CN) | 202020562611.6 |

(51) Int. Cl.

| | |
|---|---|
| ***B65D 81/07*** | (2006.01) |
| ***B65D 5/20*** | (2006.01) |
| ***B65D 73/00*** | (2006.01) |

(52) U.S. Cl.

CPC ..... *B65D 73/0014* (2013.01); *B65D 5/20* (2013.01); *B65D 73/005* (2013.01)

(58) Field of Classification Search

CPC ..... B65D 81/075; B65D 81/07; B65D 81/02; B65D 73/0014; B65D 73/005

(Continued)

(56) References Cited

U.S. PATENT DOCUMENTS

| | | | | |
|---|---|---|---|---|
| 4,087,003 | A | 5/1978 | Adamek | |
| 6,311,844 | B1 * | 11/2001 | Ridgeway | B65D 5/5035 206/583 |

(Continued)

FOREIGN PATENT DOCUMENTS

| | | | |
|---|---|---|---|
| CN | 2501839 | Y | 7/2002 |
| CN | 201999267 | U | 10/2011 |

(Continued)

OTHER PUBLICATIONS

The Extended European Search Report in European Application No. 20871327.1 dated Oct. 18, 2022, 7 pages.

(Continued)

*Primary Examiner* — Steven A. Reynolds
(74) *Attorney, Agent, or Firm* — METIS IP LLC

(57) ABSTRACT

The present disclosure may provide a package assembly for packaging an object. The package assembly may include a bottom panel, at least one group of side panels, a left panel, a right panel, and at least one fastener. The at least one fastener may correspond to the at least one group of side panels respectively. For each of the at least one fastener, the fastener may be fixedly connected to a portion of a corresponding group of side panels. The portion of the group of side panels can be folded inwardly to make the fastener contact with an object placed on the bottom panel. The left side panel and the right side panel can be folded outwardly to fasten the fastener such that the object is fixed on the bottom panel.

18 Claims, 9 Drawing Sheets

(58) Field of Classification Search
USPC ..... 206/583, 477
See application file for complete search history.

(56) References Cited

U.S. PATENT DOCUMENTS

| | | | | |
|---|---|---|---|---|
| 9,868,578 | B2 * | 1/2018 | Ridgeway | B65D 81/05 |
| 2004/0188309 | A1 | 9/2004 | Kudou et al. | |
| 2005/0252825 | A1 | 11/2005 | Lofgren et al. | |
| 2006/0102515 | A1 * | 5/2006 | McDonald | B65D 5/5059 206/583 |
| 2011/0240515 | A1 * | 10/2011 | Ridgeway | B65D 5/5028 53/472 |
| 2015/0239635 | A1 * | 8/2015 | McDonald | B65D 5/5028 206/583 |
| 2016/0052691 | A1 * | 2/2016 | Ridgeway | B65D 81/075 206/583 |
| 2017/0247163 | A1 | 8/2017 | Ridgeway | |

FOREIGN PATENT DOCUMENTS

| | | | |
|---|---|---|---|
| CN | 205574471 | U | 9/2016 |
| CN | 207482389 | U | 6/2018 |
| CN | 108263708 | A | 7/2018 |
| CN | 208307444 | U | 1/2019 |
| DE | 3739890 | A1 | 6/1989 |
| FR | 2815604 | A1 | 4/2002 |
| WO | 2016069893 | A1 | 5/2016 |
| WO | 2021063261 | A1 | 4/2021 |

OTHER PUBLICATIONS

International Search Report in PCT/CN2020/117765 dated Dec. 30, 2020, 6 pages.
Written Opinion in PCT/CN2020/117765 dated Dec. 30, 2020, 5 pages.
First Office Action in Chinese Application No. 202010298301.2 dated Feb. 2, 2021, 11 pages.

* cited by examiner

300

PACKAGE ASSEMBLY FOR PACKAGING OBJECTS

CROSS-REFERENCE TO RELATED APPLICATIONS

This application is a continuation of International Patent Application No. PCT/CN2020/117765, filed on Sep. 25, 2020, which claims priority to Chinese Patent Application No. 201921665588.7 filed on Sep. 30, 2019, Chinese Patent Application No. 202020562611.6 filed on Apr. 16, 2020, and Chinese Patent Application No. 202010298301.2 filed on Apr. 16, 2020, the entire contents of each of which are hereby incorporated by reference.

TECHNICAL FIELD

The present disclosure generally relates to object package, and in particular, to package assemblies for packaging objects.

BACKGROUND

In logistic transportation or storage processes, it is important to package objects appropriately for protection and safety. In addition, there is also a massive demand for object package in people's daily life. Therefore, it is desirable to provide package assemblies for packaging objects with low cost, ease of manufacture, and/or ease of use.

SUMMARY

One aspect of the present disclosure may provide a package assembly for packaging an object. The package assembly may include a bottom panel, at least one group of side panels, a left panel, a right panel, and at least one fastener. The at least one group of side panels may be foldably connected to the bottom panel along a first direction. The left side panel may be foldably connected to the bottom panel along a second direction. The right side panel may be foldably connected to the bottom panel along the second direction. The right side panel may be opposite to the left side panel with respect to a center line of the bottom panel. The first direction may be perpendicular to the second direction. The at least one fastener may correspond to the at least one group of side panels respectively. For each of the at least one fastener, the fastener may be fixedly connected to a portion of a corresponding group of side panels. The portion of the group of side panels can be folded inwardly to make the fastener contact with an object placed on the bottom panel. The left side panel and the right side panel can be folded outwardly to fasten the fastener such that the object is fixed on the bottom panel.

In some embodiments, each of the at least one group of side panels may include a left end panel, a middle panel, and a right end panel. The left end panel, the middle panel, and the right end panel may be separately foldable along a fold line. A corresponding fastener may include a left end and a right end fixedly connected to the left end panel and the right end panel respectively.

In some embodiments, the at least one group of side panels may include a first group of side panels and a second group of side panels located at an upper side and a lower side of the bottom panel respectively. The first group of side panels may include a first left end panel, a first middle panel, and a first right end panel which are separately foldable along a first fold line. The second group of side panels may include a second left end panel, a second middle panel, and a second right end panel which are separately foldable along a second fold line. The at least one fastener may include a first fastener and a second fastener corresponding to the first group of side panels and the second group of side panels respectively. The first fastener may include a first left end and a first right end fixedly connected to the first left end panel and the first right end panel respectively. The second fastener may include a second left end and a second right end fixedly connected to the second left end panel and the second right end panel respectively.

In some embodiments, a length of the middle panel along the first direction may be equal to a length of the bottom panel along the first direction. A length of the left end panel along the first direction may be equal to a length of the left side panel along the first direction. A length of the right end panel along the first direction may be equal to a length of the right side panel along the first direction. A length of the left side panel along the second direction may be equal to a length of the bottom panel along the second direction. A length of the right side panel along the second directions may be equal to a length of the bottom panel along the second direction.

In some embodiments, a length of the fastener along the first direction may be greater than the length of the middle panel or the length of the bottom panel along the first direction.

In some embodiments, a length of the fastener along the second direction may be smaller than a length of the middle panel along the second direction.

In some embodiments, a length of the fastener along the second direction may be larger than a length of the middle panel along the second direction so that at least a portion of the fastener is located at the bottom panel.

In some embodiments, a sum length of the at least one fastener along the second direction may be smaller than the length of the bottom panel along the second direction.

In some embodiments, the middle panel may include a left end section, a middle section, and a right end section which are foldably connected to the bottom panel along the fold line. At least one of the left end section or the right end section can be folded inwardly to press the fastener to the bottom panel such that the object can be pre-fixed on the bottom panel before the left side panel and the right side panel are folded outwardly.

In some embodiments, the bottom panel may include at least one limiting panel. The at least one limiting panel may be foldably connected to the bottom panel. The at least one limiting panel can be folded inwardly to limit movement of the object.

In some embodiments, the at least one fastener may include at least one of a film, a string, or a band.

In some embodiments, the bottom panel may include at least one opening configured to allow a protuberant portion of the object to penetrate the bottom panel.

In some embodiments, the package assembly may further include a box configured to accommodate the at least one group of side panels, the left side panel, the right side panel, the at least one fastener, and the object.

Another aspect of the present disclosure may provide a method for packaging an object. The method may include: placing an object on a bottom panel of a package assembly; folding a portion of at least one group of side panels of the package assembly inwardly to make at least one fastener of the package assembly contact with the object; and folding a left side panel and a right side panel outwardly to fasten the at least one fastener on the object.

In some embodiments, each of the at least one group of side panels may include a left end panel, a middle panel, and a right end panel. The left end panel, the middle panel, and the right end panel may be separately foldable along a fold line. A fastener corresponding to the group of side panels may include a left end and a right end fixed on the left end panel and the right end panel respectively.

In some embodiments, the at least one group of side panels may include a first group of side panels and a second group of side panels located at an upper side and a lower side of the bottom panel respectively. The first group of side panels may include a first left end panel, a first middle panel, and a first right end panel which are separately foldable along a first fold line. The second group of side panels may include a second left end panel, a second middle panel, and a second right end panel which are separately foldable along a second fold line. The at least one fastener may include a first fastener and a second fastener corresponding to the first group of side panels and the second group of side panels respectively. The first fastener may include a first left end and a first right end fixedly connected to the first left end panel and the first right end panel respectively. The second fastener may include a second left end and a second right end fixedly connected to the second left end panel and the second right end panel respectively.

In some embodiments, the middle panel may include a left end section, a middle section, and a right end section which are foldably connected to the bottom panel along the fold line. At least one of the left end section or the right end section can be folded inwardly to press the fastener to the bottom panel such that the object can be pre-fixed on the bottom panel before the left side panel and the right side panel are folded outwardly.

In some embodiments, the bottom panel may include at least one opening configured to allow a protuberant portion of the object to penetrate the bottom panel.

In some embodiments, the bottom panel may include at least one limiting panel. The at least one limiting panel may be foldably connected to the bottom panel. The at least one limiting panel can be folded inwardly to limit movement of the object.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. The drawings are not to scale. These embodiments are non-limiting schematic embodiments, in which like reference numerals represent similar structures throughout the several views of the drawings, and wherein.

DETAILED DESCRIPTION

Figure 1:
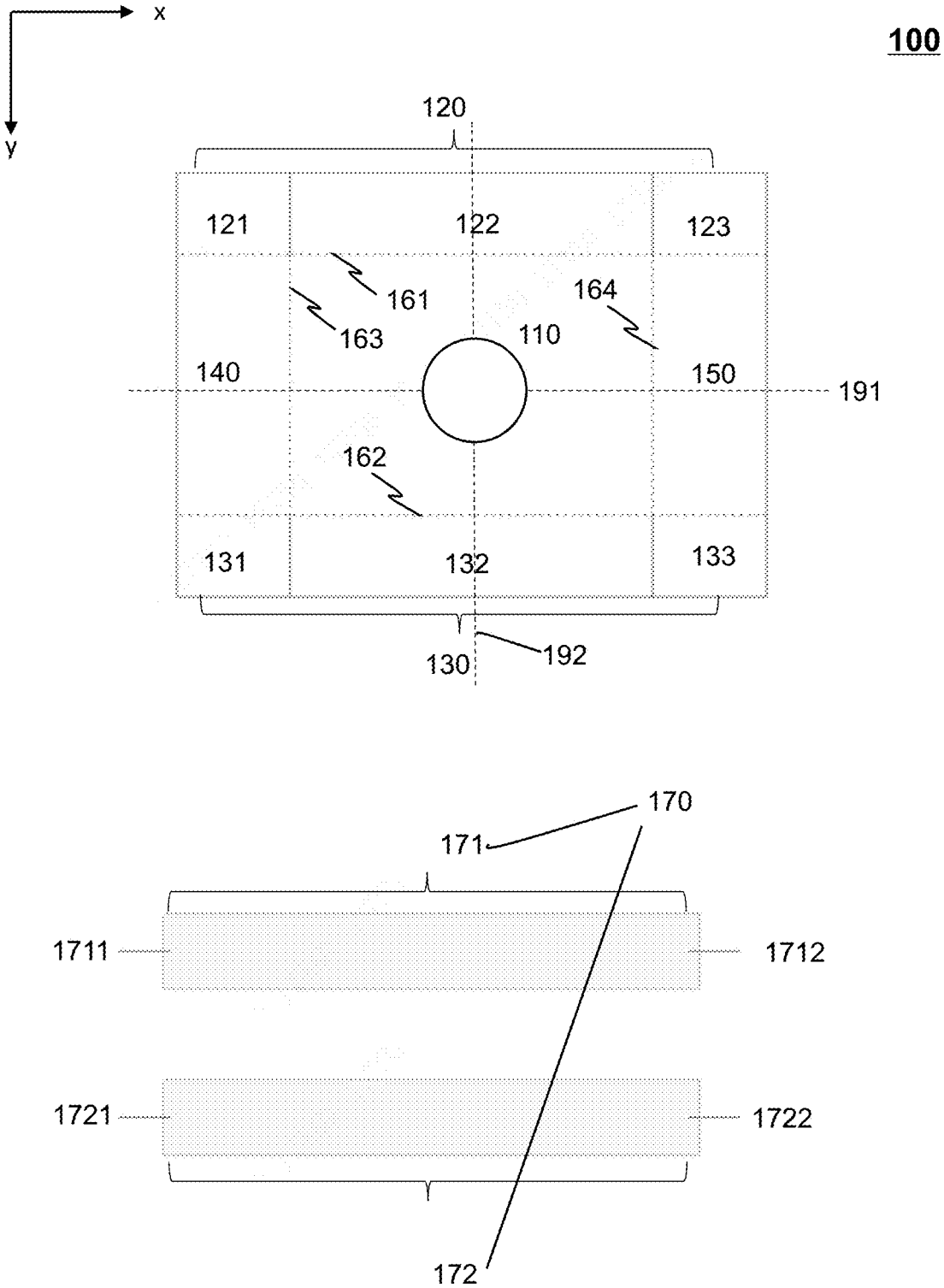
FIG. 1 is a schematic diagram illustrating an exemplary package assembly according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "on," "connected to," or "coupled to," another element, it may be directly on, connected or coupled to, or communicate with the other element may be present, unless the context clearly indicates otherwise. As used herein, the term "and/or" includes any and all combinations of one or more of the associated listed items.

It will be understood that, although the terms "first," "second," "third," etc., may be used herein to describe various elements, these elements should not be limited by these terms. These terms are only used to distinguish one element from another and not intended to describe sequential orders or importance degrees of corresponding elements. For example, a first element could be termed as a second element, and, similarly, a second element could be termed as a first element, without departing from the scope of exemplary embodiments of the present disclosure.

Spatial and/or functional relationships among elements are described using various terms, including "contact," "connected," "attached," "mounted," etc. Unless explicitly described as being "direct," when a relationship between a first element and a second element is described in the present disclosure, the relationship includes a direct relationship where no other intervening elements are present between the first element and the second element, and also an indirect relationship where one or more intervening elements are present (either spatially or functionally) between the first element and the second element. In contrast, when an element is referred to as being "directly" connected, attached, or positioned to another element, there are no intervening elements present. Other words used to describe the relationship among elements should be interpreted in a similar manner (e.g., "between," versus "directly between," "adjacent," versus "directly adjacent").

It should also be understood that terms such as "top," "bottom," "upper," "lower," "vertical," "lateral," "above," "below," "upward(s)," "downward(s)," "left-hand side," "right-hand side," "left," "right," "horizontal," "inward," "outward," and other such spatial reference terms are used in a relative sense to describe the positions or orientations of certain surfaces/parts/components of a package assembly with respect to other such features of the package assembly.

In the present disclosure, "fold inwardly" refers to folding an element towards an upper surface of a bottom panel and "fold outwardly" refers to folding an element towards a lower surface of a bottom panel.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure.

The flowcharts used in the present disclosure illustrate operations that systems implement according to some embodiments of the present disclosure. It is to be expressly understood, the operations of the flowcharts may be implemented not in order. Conversely, the operations may be implemented in inverted order, or simultaneously. Moreover, one or more other operations may be added to the flowcharts. One or more operations may be removed from the flowcharts.

An aspect of the present disclosure relates to a package assembly for packaging an object. The package assembly may include a bottom panel, at least one group of side panels (e.g., two groups of side panels respectively located at an upper side and a lower side of the bottom panel), a left side panel, a right side panel. The at least one group of side panels may be foldably connected to the bottom panel along a first direction (e.g., the x-axis illustrated in FIG. 1). The left side panel and the right side panel may be foldably connected to the bottom panel along a second direction (e.g., the y-axis illustrated in FIG. 1) perpendicular to the first direction. The package assembly may also include at least one fastener (e.g., two fasteners) corresponding the at least one group of side panels respectively. A portion (e.g., a left end and a right end) of each of the at least one fastener may be fixedly connected to a portion of a corresponding group of side panels. The portion of the group of side panels can be folded inwardly to make the fastener contact with an object placed on the bottom panel. The left side panel and the right side panel can be folded outwardly to fasten the fastener such that the object is fixed on the bottom panel.

According to the design of the package assembly, the manufacture of the package assembly is simple and the object can be easily packaged and stably fixed on the bottom panel. In some embodiments, the panels and the at least one fastener may be made of a recycled and renewable material, and the at least one fastener may only cover a portion of the object instead of covering the whole object, thereby reducing a material cost of the package assembly and reducing environmental impact.

FIG. 1 is a schematic diagram illustrating an exemplary package assembly according to some embodiments of the present disclosure. The package assembly 100 may be configured to package an object (e.g., a commodity, a product). As illustrated in FIG. 1, the package assembly 100 may include a bottom panel 110, at least one group of side panels (e.g., a first group of side panels 120 located at an upper side, a second group of side panels 130 located at a lower side), a left side panel 140, a right side panel 150, and at least one fastener 170 corresponding to the at least one group of side panels respectively. In the present disclosure, the panels can be collectively referred to as "panel." In some embodiments, the panel may be made of a paper-based material, a plastic material, a resin, etc.

The bottom panel 110 may be configured to support the object to be packaged by the package assembly 100. In some embodiments, a shape of the bottom panel 110 may be a polygon (e.g., a quadrangle, a pentagon, a hexagon).

The at least one group of side panels may be foldably connected to the bottom panel 110 along a first direction (e.g., the x-axis illustrated in FIG. 1). In some embodiments, as described above, the at least one group of side panels may include a first group of side panels 120 and a second group of side panels 130 located at an upper side and a lower side of the bottom panel 110 respectively. In some embodiments, the first group of side panels 120 and the second group of side panels 130 may be foldably connected to the bottom panel 110 along the first direction and may be opposite to each other with respect to a first center line 191 of the bottom panel 110 along the first direction. In some embodiments, each of the at least one group of side panels may include a left end panel, a middle panel, and a right end panel. For example, the first group of panels 120 may include a first left end panel 121, a first middle panel 122, and a first right end panel 123; the second group of side panels 130 may include a second left end panel 131, a second middle panel 132, and a second right end panel 133. In some embodiments, the left end panel, the middle panel, and the right end panel may be separately foldable along a fold line (e.g., a fold line parallel to the first center line). For example, the first left end panel 121, the first middle panel 122, and the first right end panel 123 are separately foldable along a first fold line 161; the second left end panel 131, the second middle panel 132, and the second right end panel 133 are separately foldable along a second fold line 162. In some embodiments, a length of the left end panel, a length of the middle panel, and a length of the right end panel along a second direction (e.g., the y-axis illustrated in FIG. 1) that is perpendicular to the first direction may be the same or different.

The left side panel 140 and the right side panel 150 may be foldably connected to the bottom panel 110 along the second direction (e.g., the y-axis illustrated in FIG. 1). In some embodiments, the left side panel 140 and the right side panel 150 may be opposite to each other with respect to a second center line 192 of the bottom panel 110 along the second direction. In some embodiments, the left side panel 140 and the right side panel 150 may be foldable along a fold line (e.g., a fold line parallel to the second center line). For example, the left side panel 140 may be foldable along a fold line 163; the right side panel 150 may be foldable along a fold line 164.

In some embodiments, as described above, a shape of the bottom panel 110 may be a polygon (e.g., a quadrangle, a pentagon, a hexagon). Accordingly, the at least one group of side panels (e.g., the first group of side panels 120, the second group of side panels 130), the left side panel 140, and the right side panel 150 may be located along a periphery of the polygon. Take the bottom panel 110 with the quadrangle shape as an example, the first group of side panels 120, the second group of side panels 130, the left side panel 140, and the right side panel 150 may be located along four sides of the quadrangle; and corresponding fold lines of the side panels are four edges of the quadrangle.

In some embodiments, a length of the middle panel (e.g., the first middle panel 122, the second middle panel 132) along the first direction may be equal to a length of the bottom panel 110 along the first direction; a length of the left end panel (e.g., the first left end panel 121, the second left end panel 131) along the first direction may be equal to a length of the left side panel 140 along the first direction; a length of the right end panel (e.g., the right end panel 123, the right end panel 133) along the first direction may be equal to a length of the right side panel 150 along the first direction. In some embodiments, a length of the left side panel 140 along the second direction may be equal to a length of the bottom panel 110 along the second direction; a length of the right side panel 150 along the second direction may be equal to the length of the bottom panel 110 along the second direction.

The at least one fastener 170 may be configured to fasten the object to be packaged by the package assembly 100. In some embodiments, the at least one fastener 170 may be fixedly connected to the at least one group of side panels. In some embodiments, the at least one fastener 170 may be fixedly connected to the at least one group of side panels via an adhesive manner, for example, a heat-activated adhesive manner, a co-adhesive manner, a tape manner (e.g., a pressure-sensitive tape manner, a glue manner), etc. In some embodiments, an adhesive used in the adhesive manner may include an epoxy, a silicon, etc. In some embodiments, the adhesive may be located at the at least one fastener 170 and/or the at least one group of side panels.

In some embodiments, the at least one fastener 170 may be made of a flexible material. Accordingly, the at least one fastener 170 can stretch under tension and tend to return its original state (e.g., an un-stretched state) without tension. In some embodiments, the flexible material may include polyethylene, polypropylene, polyester, polyvinyl chloride, cellulose acetate, cellophane, polyurethane, or the like, or any combination thereof. In some embodiments, the at least one fastener may include a film, a string, a band, etc.

In some embodiments, the at least one fastener 170 may correspond to the at least one group of side panels respectively. Accordingly, each of the at least one fastener 170 may be fixedly connected to a portion of a corresponding group of side panels. The portion of the group of side panels can be folded inwardly to make the fastener contact with the object placed on the bottom panel 110. Further, the left side panel 140 and the right side panel 150 can be folded outwardly to fasten the fastener such that the object can be fixed on the bottom panel 110. More descriptions may be found elsewhere in the present disclosure (e.g., FIGS. 2A-2F and the descriptions thereof).

In some embodiments, each of the at least one fastener 170 may include a left end and a right end, the left end and the right end may be respectively fixedly connected to a left end panel and a right end panel of a corresponding group of side panels. For example, the at least one fastener 170 may include a first fastener 171 corresponding to the first group of side panels 120 and a second fastener 172 corresponding to the second group of side panels 130. Accordingly, the first fastener 171 may include a first left end 1711 and a first right end 1712 connected to the first left end panel 121 and the first right end panel 123 respectively; the second fastener 172 may include a second left end 1721 and a second right end 1722 connected to the second left end panel 131 and the second right end panel 133 respectively.

In some embodiments, take a specific fastener (e.g., the first fastener 171) as an example, a length of the fastener along the first direction may be greater than a length of a middle panel (e.g., the first middle panel 122) of a corresponding group of side panels (e.g., the first group of side panels 120) or the length of the bottom panel 110 along the first direction, which can ensure that the fastener can fasten the object placed on the bottom panel 110. In some embodiments, the length of the fastener along the first direction may be also equal to or smaller than a sum of lengths of a left end panel, the middle panel, and a right end panel of the corresponding group of side panels, and can avoid material waste.

In some embodiments, a sum length of the at least one fastener 170 along the second direction may be smaller than the length of the bottom panel 110 along the second direction, such that only a portion of the object may be wrapped by the at least one fastener 170 while the object is fixed on the bottom panel 110, which can reduce material cost (or avoid material waste).

In some embodiments, also take a specific fastener (e.g., the first fastener 171) as an example, a length of the fastener along the second direction may be smaller than a length of a middle panel (e.g., the first middle panel 122) of a corresponding group of side panels (e.g., the first group of side panels 120) along the second direction. Accordingly, the fastener only partially covers the corresponding group of side panels along the second direction, for example, an edge of the fastener near the bottom panel 110 does not cross over a fold line (e.g., the first fold line 161) of the corresponding group of side panels. In some embodiments, the length of the fastener along the second direction may be equal to the length of the middle panel (e.g., the first middle panel 122) of the corresponding group of side panels (e.g., the first group of side panels 120) along the second direction. Accordingly, the fastener substantially totally covers the corresponding group of side panels along the second direction (it is assumed that a shape of the fastener is a quadrangle), for example, an edge of the fastener near the bottom panel 110 substantially overlaps the fold line (e.g., the first fold line 161) of the corresponding group of side panels. More descriptions may be found in FIGS. 2A-2F and the descriptions thereof.

In some embodiments, the length of the fastener along the second direction may be larger than the length of the middle panel of the corresponding group of side panels along the second direction such that at least a portion of the fastener is located at the bottom panel 110. More descriptions may be found in FIGS. 3A-3C and the descriptions thereof.

In some embodiments, the bottom panel 110 may include at least one opening. The at least one opening may be configured to allow a protuberant portion of the object to penetrate the bottom panel 110. The object may be suspended on the bottom panel 110 via the at least one opening. In some embodiments, a size of the at least one opening should be smaller than a size of the object such that the object does not leak out of the bottom panel 110. In some embodiments, a position of the at least one opening on the bottom panel 110 and/or the size of the at least one opening may be adjustable under different situations such that the package assembly 100 can be used to package different objects.

In some embodiments, for each of the at least one group of side panels, the middle panel (e.g., the first middle panel 122, the second middle panel 132) may include a left end section, a middle section, and a right end section which are foldably connected to the bottom panel 110 along a corresponding fold line (e.g., the first fold line 161, the second fold line 162). In some embodiments, at least one of the left end section or the right end section can be folded inwardly to press the fastener to the bottom panel 110 such that the object can be pre-fixed on the bottom panel 110 before the left side panel 140 and the right side panel 150 are folded outwardly. More descriptions may be found in FIGS. 4A-4E and the descriptions thereof.

In some embodiments, the bottom panel 110 may include at least one limiting panel. The at least one limiting panel may be foldably connected to the bottom panel 110 and can be folded inwardly to abut a portion of the object, thereby limiting movement of the object. In some embodiments, the at least one limiting panel may be part of the bottom panel 110. For example, the at least one limiting panel may be formed by making a cut on the bottom panel 110. In some embodiments, the at least one limiting panel may be independent and connected to the bottom panel 110. For example, the at least one limiting panel may be connected to the bottom panel 110 via an adhesive manner, (e.g., a heat-activated adhesive manner, a co-adhesive manner, a tape manner (e.g., a pressure-sensitive tape manner, a glue manner)), a staple, etc. In some embodiments, the bottom panel may include two limiting panels opposite each other with respect to the second center line of the bottom panel along the second direction. It should be noted that a count of the at least one limiting panel is non-limiting, for example, 2, 4, 6, etc. More descriptions may be found in FIGS. 5A and 5B and the descriptions thereof.

In some embodiments, the package assembly 100 may also include a box configured to accommodate the panels (i.e., the bottom panel 110, the at least one group of side panels (e.g., the first group of side panels 120, the second group of side panels 130), the left side panel 140, the right side panel 150) the at least one fastener 170, and the object.

FIGS. 2A-2F are schematic diagrams illustrating an exemplary process for packaging an object using a package assembly according to some embodiments of the present disclosure.

Figure 2A:
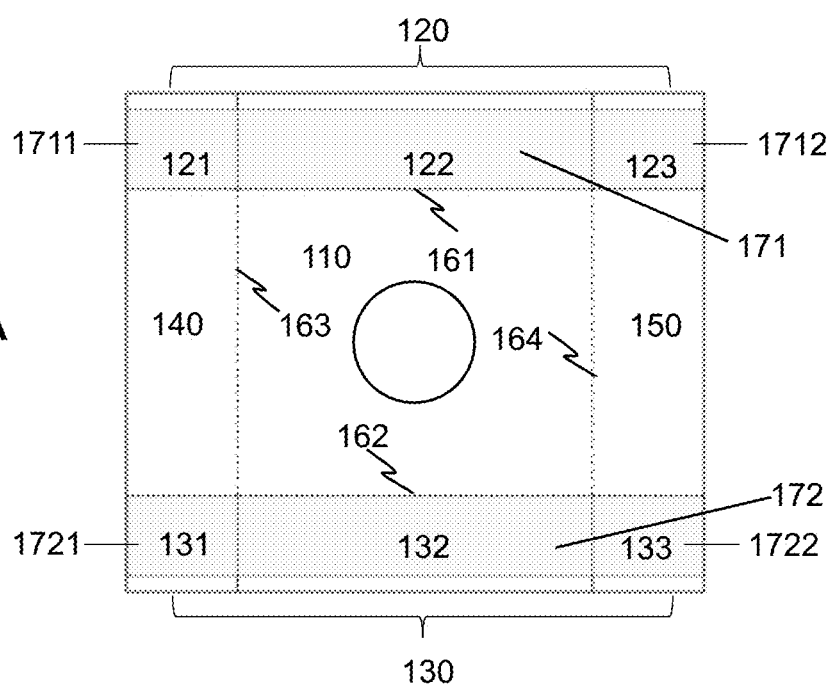
FIGS. 2A-2F are schematic diagrams illustrating an exemplary process for packaging an object using a package assembly according to some embodiments of the present disclosure.

As described in connection with FIG. 1, the package assembly 200 may include the bottom panel 110, the first group of side panels 120, the second group of side panels 130, the left side panel 140, the right side panel 150, the first fastener 171, and the second fastener 172. As illustrated in FIG. 2A, the length of the first fastener 171 along the second direction is smaller than the length of the first middle panel 122 along the second direction; the length of the second fastener 172 along the second direction is smaller than the length of the second middle panel 132 along the second direction. The first fastener 171 may include a first left end 1711 and a first right end 1712 which may be fixedly connected to the first left end panel 121 and the first right end panel 123 respectively; the second fastener 172 may include a second left end 1721 and a second right end 1722 which may be fixedly connected to the second left end panel 131 and the second right end panel 133 respectively.

Figure 2B:
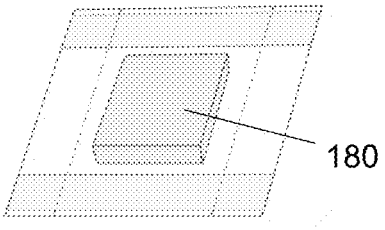
Figure 2C:
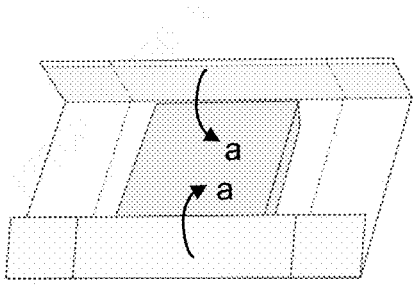
Figure 2D:
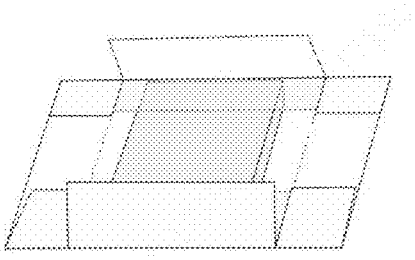

As illustrated in FIGS. 2B-2D, an object 180 is placed on the bottom panel 110, then a portion (e.g., the first left end panel 121, the first right end panel 123) of the first group of side panels 120 and a portion (e.g., the second left end panel 131, the second right end panel 133) of the second group of side panels 130 are respectively folded inwardly along directions indicating by an arrow a to make the first fastener 171 and the second fastener 172 contact with the object 180; in the meantime, as illustrated in FIG. 2D, the portion (e.g., the first left end panel 121, the first right end panel 123) of the first group of side panels 120 and the portion (e.g., the left end panel 131, the right end panel 133) of the second group of side panels 130 contact with the left side panel 140 and the right side panel 150 respectively. In this process, as illustrated in FIG. 2C and FIG. 2D, the first middle panel 122 and the second middle panel 132 may be simultaneously folded inwardly by a specific angle (e.g., 90°), which can form a support space for the object 180. Additionally or alternatively, the first middle panel 122 and the second middle panel 132 may be remained unchanged (i.e., remained flat as illustrated in FIG. 2B). Additionally or alternatively, the first middle panel 122 and the second middle panel 132 may be folded outwardly by a specific angel (e.g., 90°, 180°).

Figure 2E:
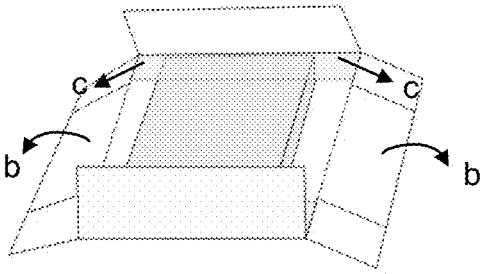
Figure 2F:
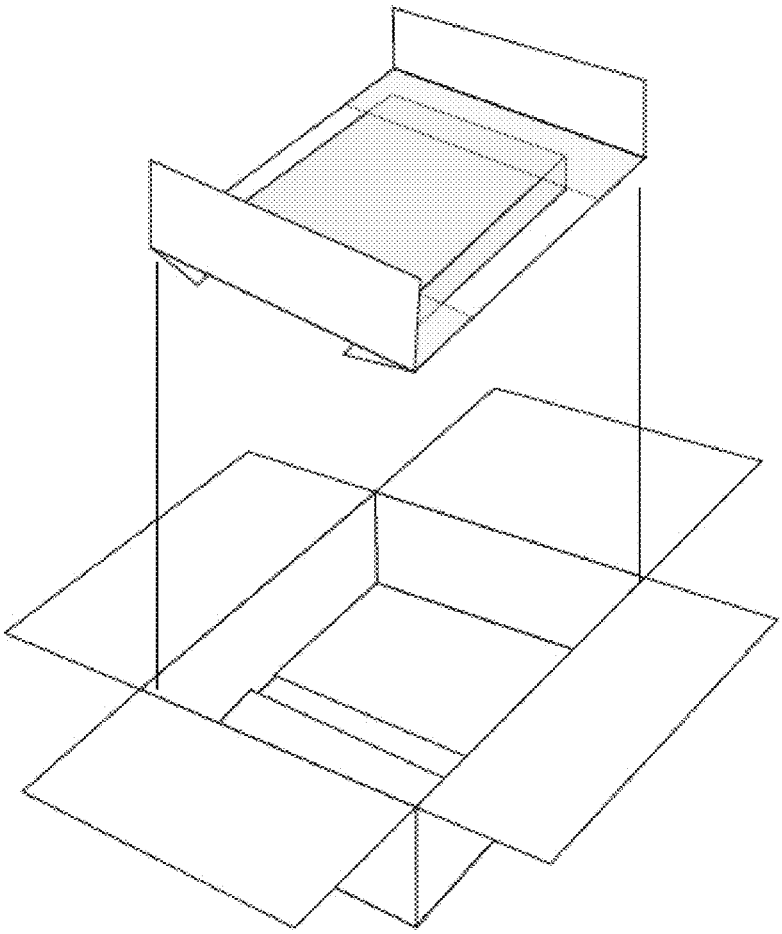

Further, as illustrated in FIG. 2E, the left side panel 140 and the right side panel 150 are respectively folded outwardly together with the portion of the first group of side panels 120 and the portion of the second group of side panels 130 along directions indicating by an arrow b to fasten the first fastener 171 and the second fastener 172 along directions indicating by an arrow c such that the object 180 is fixed on the bottom panel 110 as illustrated in FIG. 2F.

Figure 3A:
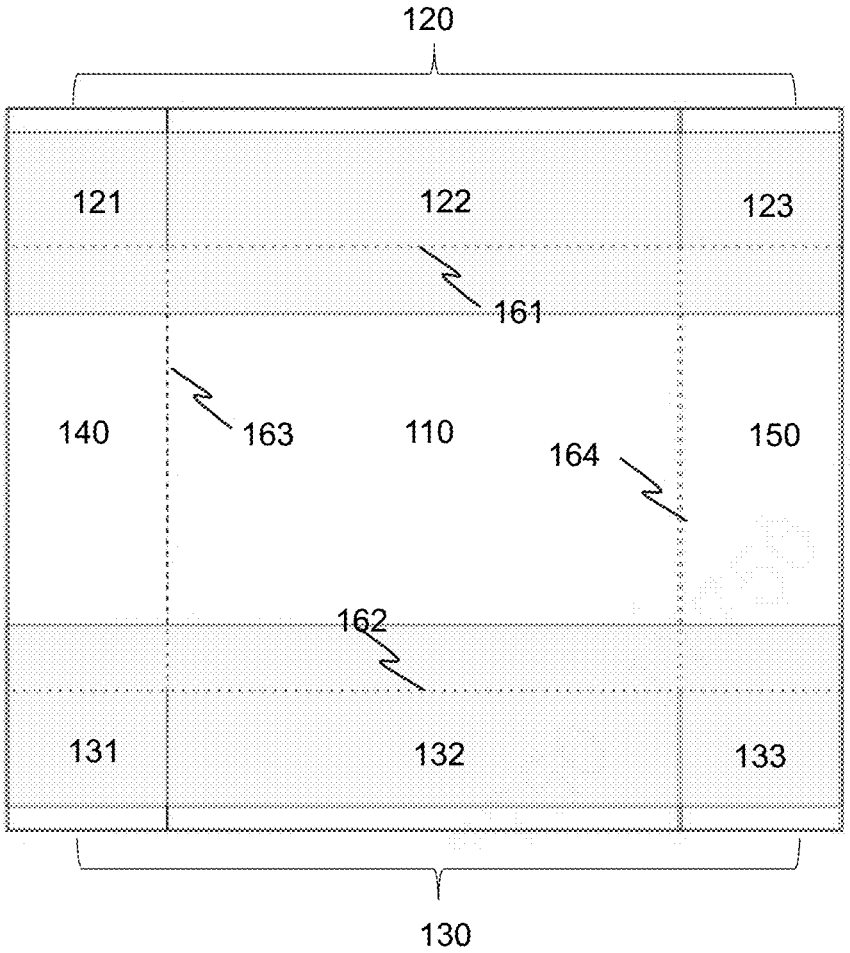
FIGS. 3A-3C are schematic diagrams illustrating an exemplary process for packaging an object using a package assembly according to some embodiments of the present disclosure.
Figure 3B:
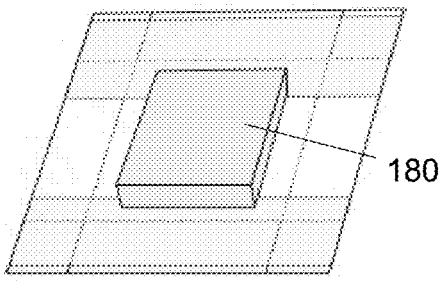
Figure 3C:
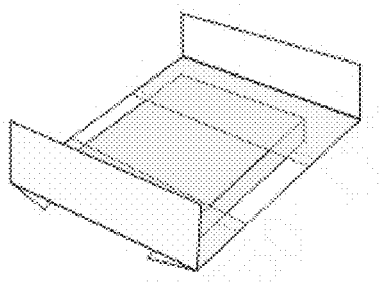

FIGS. 3A-3C are schematic diagrams illustrating an exemplary process for packaging an object using a package assembly according to some embodiments of the present disclosure.

As illustrated in FIG. 3A, the package assembly 300 is similar to the package assembly 200 except that the length of the first fastener 171 along the second direction is larger than the length of the first middle panel 122 along the second direction and the length of the second fastener 172 along the second direction is larger than the length of the second middle panel 132 along the second direction.

As described in connection with FIGS. 2B-2E, the object 180 may be packaged in a similar manner of which relevant descriptions are not repeated herein. As illustrated in FIG. 3B, when the object 180 is placed on the bottom panel 110, the lower surface of the object 180 contacts with a portion of the first fastener 171 and the second fastener 172. Accordingly, as illustrated in FIG. 3C, the first fastener 171 and the second fastener 172 can wrap multiple portions (e.g., an upper portion, a lower portion, a side portion) of the object 180, thereby improving package stability.

FIGS. 4A-4E are schematic diagrams illustrating an exemplary process for packaging an object using a package assembly according to some embodiments of the present disclosure.

Figure 4A:
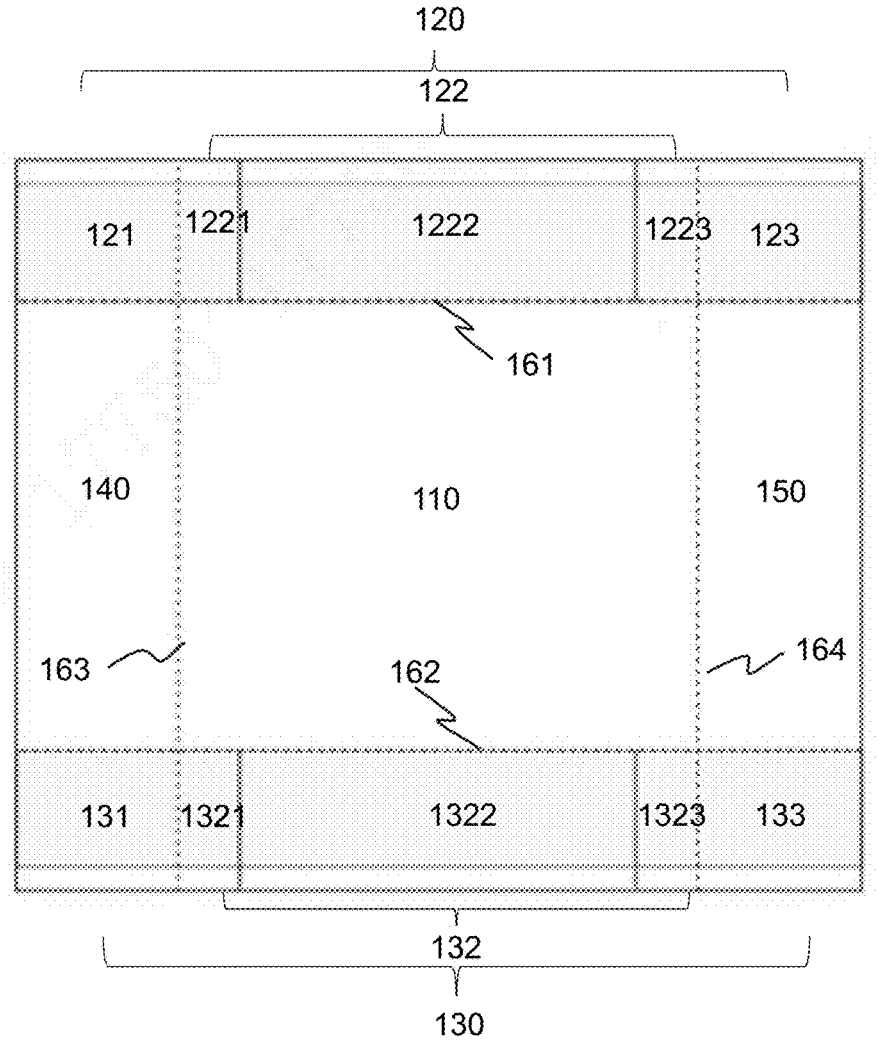
FIGS. 4A-4E are schematic diagrams illustrating an exemplary process for packaging an object using a package assembly according to some embodiments of the present disclosure.

As illustrated in FIG. 4A, the package assembly 400 is similar to the package assembly 200 except that the first middle panel 122 includes a first left end section 1221, a first middle section 1222, and a first right end section 1223 and the second middle panel 132 includes a second left end section 1321, a second middle section 1322, and a second right end section 1323. The first left end section 1221, the first middle section 1222, and the first right end section 1223 may be foldably connected to the bottom panel 110 along the fold line 161 separately. The second left end section 1321, the second middle section 1322, and the second right end section 1323 may be foldably connected to the bottom panel 110 along the fold line 162 separately.

Figure 4B:
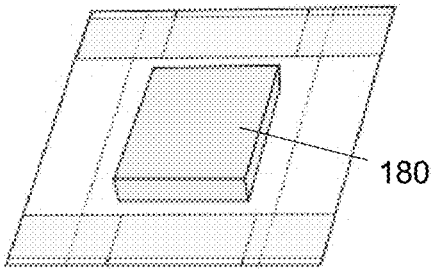
Figure 4C:
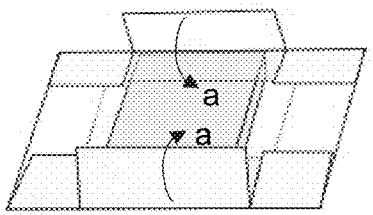
Figure 4D:
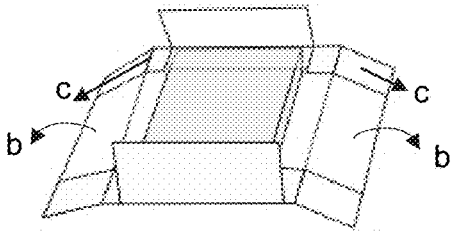

As illustrated in FIG. 4B and FIG. 4C the object 180 is placed on the bottom panel 110, then a portion (e.g., the first left end panel 121, the first left end section 1221, the first right end section 1223, the first right end panel 123) of the first group of side panels 120 and a portion (e.g., the second left end panel 131, the second left end section 1321, the second right end section 1323, the second right end panel 133) of the second group of side panels 130 are respectively folded inwardly along directions indicating by an arrow a to make the first fastener 171 and the second fastener 172 contact with the object 180; in the meantime, as illustrated in FIG. 4D, the portion (e.g., the first left end panel 121, the first left end section 1221, the first right end section 1223, the first right end panel 123) of the first group of side panels 120 and the portion (e.g., the second left end panel 131, the second left end section 1321, the second right end section 1323, the second right end panel 133) of the second group of side panels 130 contact with the left side panel 140, the right side panel 150, and the bottom panel 110. In this process, as illustrated in FIG. 4C and FIG. 4D, the first middle panel 122 and the second middle panel 132 may be simultaneously folded inwardly by a specific angle (e.g., 90°), which can form a support space for the object 180. Additionally or alternatively, the first middle panel 122 and the second middle panel 132 may be remained unchanged (i.e., remained flat as illustrated in FIG. 4B). Additionally or alternatively, the first middle panel 122 and the second middle panel 132 may be folded outwardly by a specific angel (e.g., 90°, 180°).

Figure 4E:
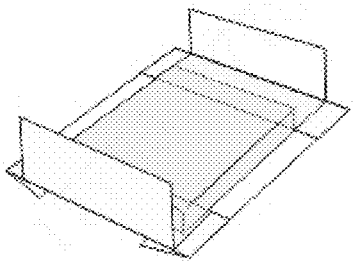

Further, as illustrated in FIG. 4D, the left side panel 140 and the right side panel 150 are respectively folded outwardly together with the first left end panel 121, the right end panel 123, the left end panel 131, and the right end panel 133 along directions indicating by an arrows b to fasten the first fastener 171 and the second fastener 172 along directions indicating by an arrow c. As illustrated in FIG. 4E, the first left end section 1221 and the first right end section 1223 are pressed on the fastener 171 to make the fastener 171 contact with the bottom panel 110 closely; similarly, the second left end section 1321 and the second right end section 1323 are pressed on the fastener 172 to make the fastener 172 contact with the bottom panel 110 closely, accordingly, the object 180 can be fixed on the bottom panel 110 stably.

Figure 5A:
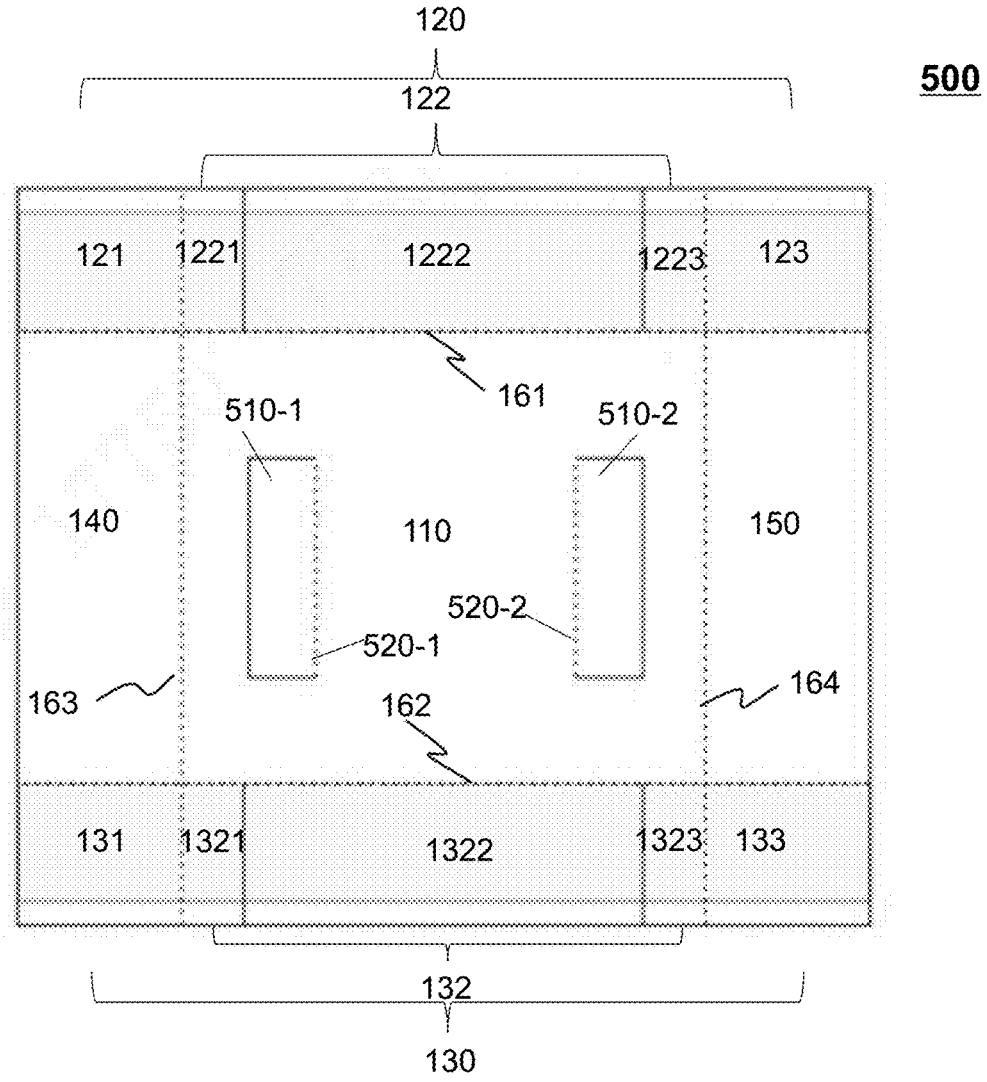
FIG. 5A and FIG. 5B are schematic diagrams illustrating an exemplary process for packaging an object using a package assembly according to some embodiments of the present disclosure.
Figure 5B:
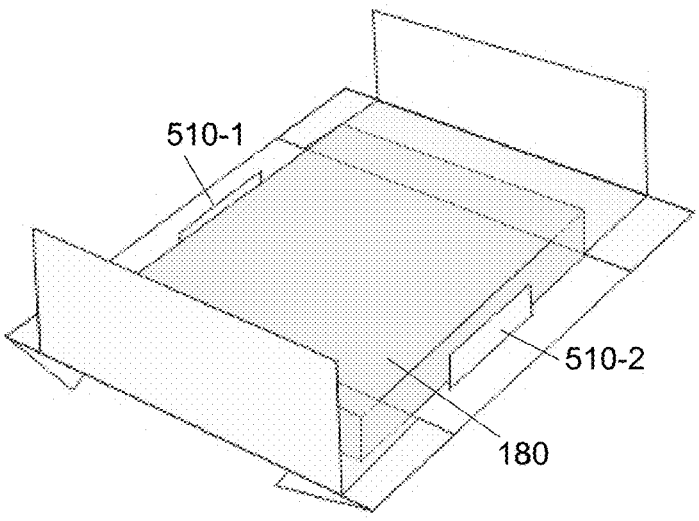

FIG. 5A and FIG. 5B are schematic diagrams illustrating an exemplary process for packaging an object using a package assembly according to some embodiments of the present disclosure.

As illustrated in FIG. 5A, the package assembly 500 is similar to the package assembly 400 except that the bottom panel 110 further includes a first limiting panel 510-1 and a second limiting panel 510-2 foldably connected to the bottom panel 110. As described in connection with FIGS. 4B-4E, the object 180 may be packaged in a similar manner of which relevant descriptions are not repeated herein. As illustrated in FIG. 5B, the first limiting panel 510-1 and the second limiting panel 510-2 can be respectively folded inwardly along a first fold line 520-1 and a second fold line 520-2 to limit movement of the object 180 such that the object 180 can be fixed on the bottom panel 110 stably.

Figure 6:
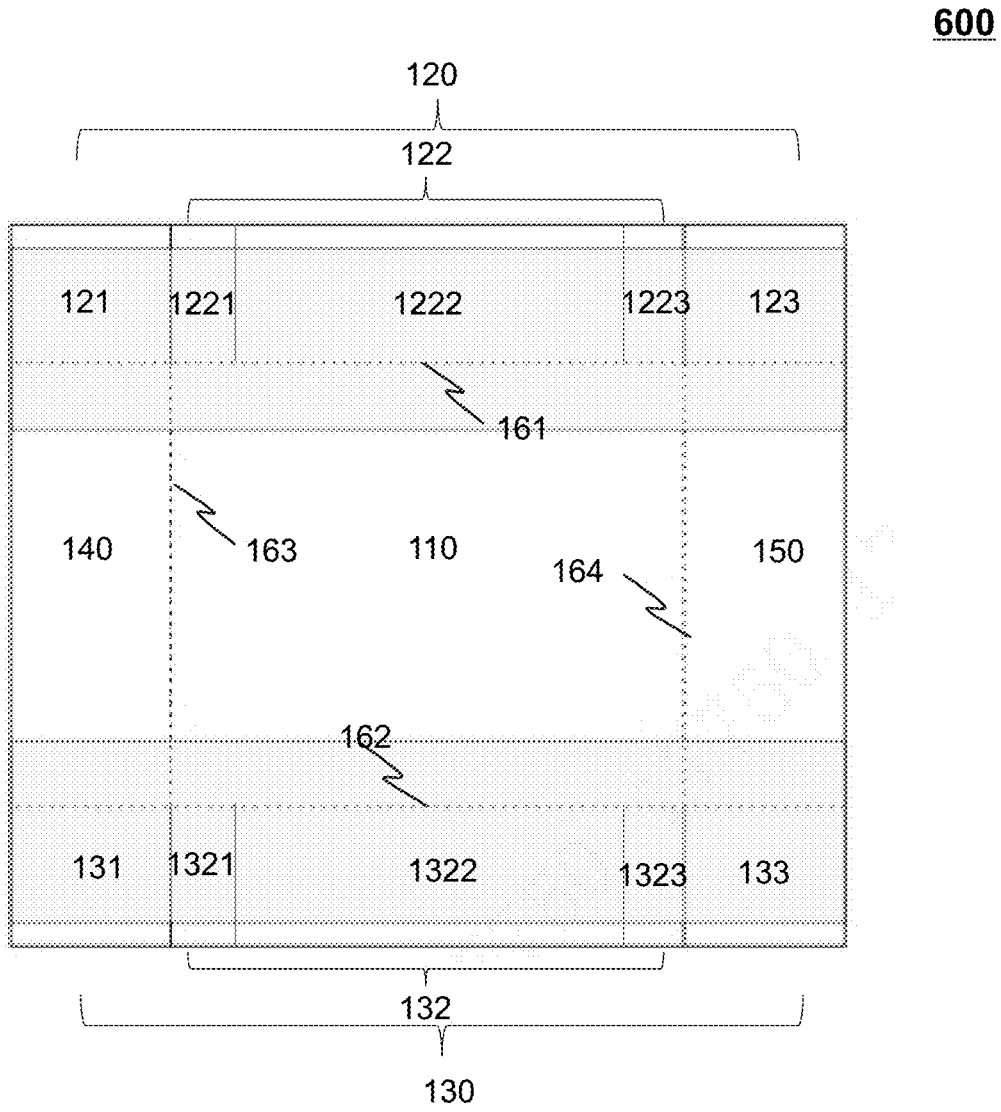
FIG. 6 is a schematic diagram illustrating an exemplary package assembly according to some embodiments of the present disclosure.

FIG. 6 is a schematic diagram illustrating an exemplary package assembly according to some embodiments of the present disclosure.

As illustrated in FIG. 6, the package assembly 600 is similar to the package assembly 400 except that the length of the first fastener 171 along the second direction is larger than the length of the first middle panel 122 along the second direction and the length of the second fastener 172 along the second direction is larger than the length of the second middle panel 132 along the second direction.

Figure 7:
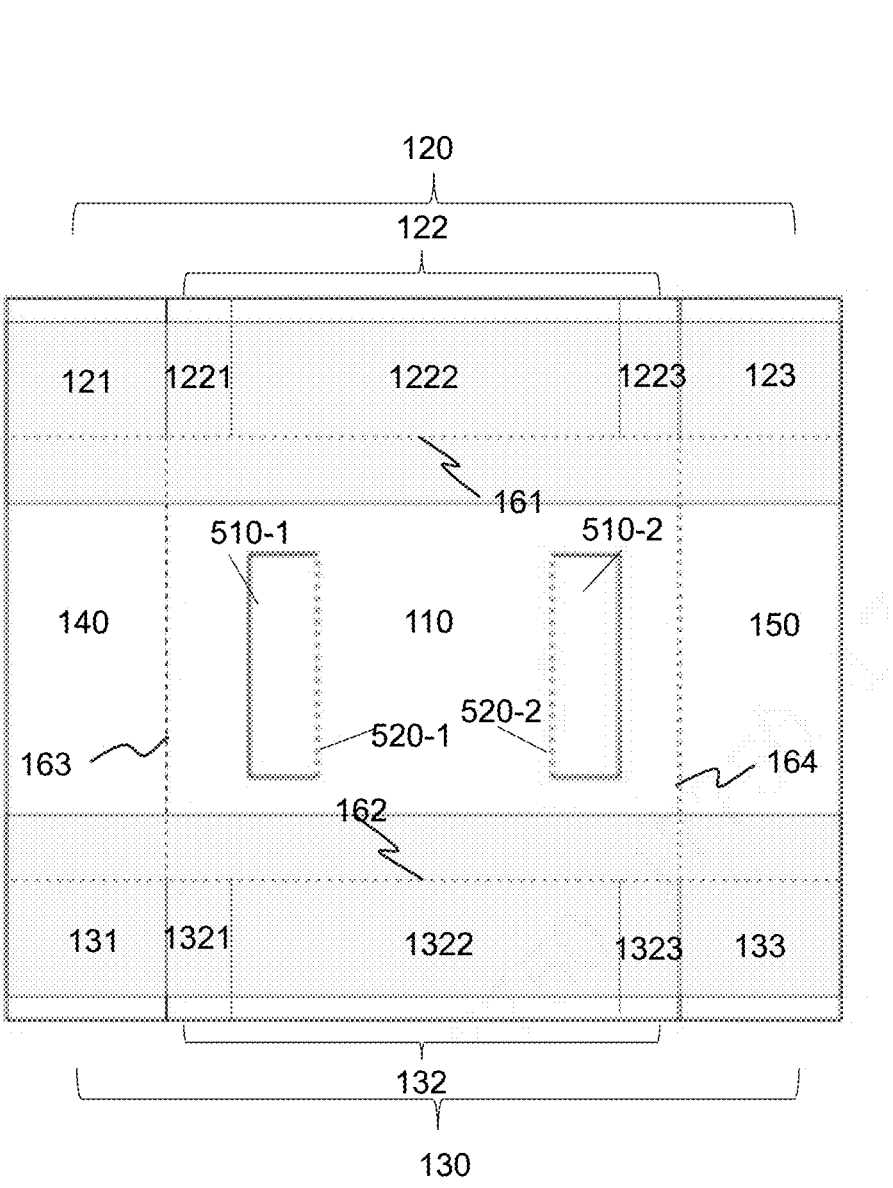
FIG. 7 is a schematic diagram illustrating an exemplary package assembly according to some embodiments of the present disclosure.

FIG. 7 is a schematic diagram illustrating an exemplary package assembly according to some embodiments of the present disclosure.

As illustrated in FIG. 7, the package assembly 700 is similar to the package assembly 500 except that the length of the first fastener 171 along the second direction is larger than the length of the first middle panel 122 along the second direction and the length of the second fastener 172 along the second direction is larger than the length of the second middle panel 132 along the second direction.

Figure 8:
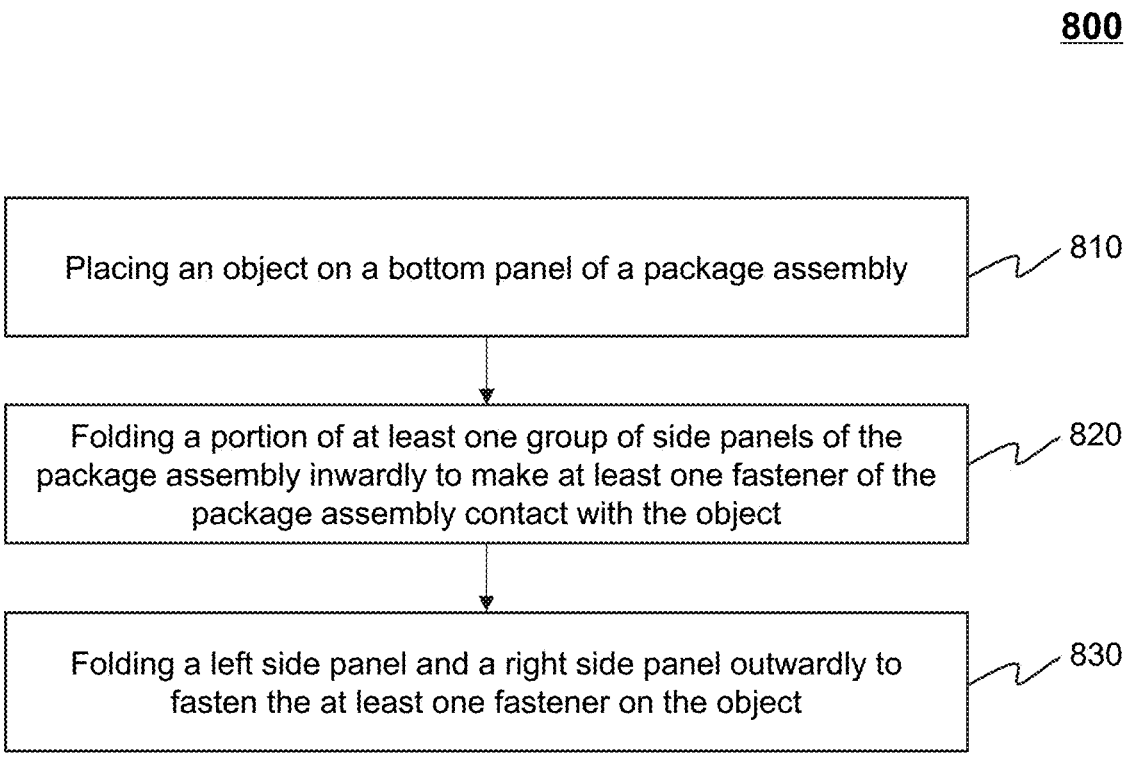
FIG. 8 is a flowchart illustrating an exemplary process for packaging an object according to some embodiments of the present disclosure.

FIG. 8 is a flowchart illustrating an exemplary process for packaging an object according to some embodiments of the present disclosure.

In 810, an object (e.g., the object 180 illustrated in FIGS. 2A-5B) may be placed on a bottom panel (e.g., the bottom panel 110 illustrated in FIGS. 2A-7) of a package assembly (e.g., the package assemblies 200, 300, 400, 500, 600, 700 illustrated in FIGS. 2A-7).

In 820, a portion of at least one group of side panels of the package assembly may be folded inwardly to make at least one fastener of the package assembly contact with the object.

In 830, a left side panel and a right side panel may be folded outwardly to fasten the at least one fastener on the object. Thus, the object may be fixed on the bottom panel. More descriptions regarding the package assembly may be found elsewhere in the present disclosure (e.g., FIGS. 1-7).

In some embodiments, the process 800 described above may be implemented by a packer or an automatic device (e.g., an automatic arm, a robot).

It should be noted that the above description is merely provided for the purposes of illustration, and not intended to limit the scope of the present disclosure. For persons having ordinary skills in the art, multiple variations or modifications may be made under the teachings of the present disclosure. However, those variations and modifications do not depart from the scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in smaller than all features of a single foregoing disclosed embodiment.

We claim:

1. A package assembly for packaging an object, comprising:

a bottom panel;

at least one group of side panels foldably connected to the bottom panel along a first direction;

a left side panel foldably connected to the bottom panel along a second direction;

a right side panel foldably connected to the bottom panel along the second direction, wherein the right side panel is opposite to the left side panel with respect to a center line of the bottom panel; and the first direction is perpendicular to the second direction; and at least one fastener corresponding to the at least one group of side panels respectively, wherein each of the at least one group of side panels includes a left end panel, a middle panel, and a right end panel, the left end panel, the middle panel, and the right end panel are separately foldable along a fold line, the left end panel is foldably connected to the left side panel, the right end panel is foldably connected to the right side panel, and for each of the at least one fastener, the at least one fastener includes a left end and a right end, which are fixedly connected to the left end panel and the right end panel respectively, wherein the left end panel and the right end panel can be folded inwardly respectively against the left side panel and the right side panel to make the at least one fastener contact with an object placed on the bottom panel; and the left side panel connected with the left end panel together with the left end panel and the right side panel connected with the right end panel together with the right end panel can be folded outwardly to fasten the at least one fastener such that the object is fixed on the bottom panel.

2. The package assembly of claim 1, wherein the at least one group of side panels includes a first group of side panels and a second group of side panels located at an upper side and a lower side of the bottom panel respectively, wherein the first group of side panels includes a first left end panel, a first middle panel, and a first right end panel which are separately foldable along a first fold line; and the second group of side panels includes a second left end panel, a second middle panel, and a second right end panel which are separately foldable along a second fold line; and the at least one fastener includes a first fastener and a second fastener corresponding to the first group of side panels and the second group of side panels respectively, wherein the first fastener includes a first left end and a first right end fixedly connected to the first left end panel and the first right end panel respectively; and the second fastener includes a second left end and a second right end fixedly connected to the second left end panel and the second right end panel respectively.

3. The package assembly of claim 1, wherein a length of the middle panel along the first direction is equal to a length of the bottom panel along the first direction;

a length of the left end panel along the first direction is equal to a length of the left side panel along the first direction;

a length of the right end panel along the first direction is equal to a length of the right side panel along the first direction;

a length of the left side panel along the second direction is equal to a length of the bottom panel along the second direction; and a length of the right side panel along the second direction is equal to a length of the bottom panel along the second direction.

4. The packing assembly of claim 3, wherein a length of the at least one fastener along the first direction is greater than the length of the middle panel or the length of the bottom panel along the first direction.

5. The packing assembly of claim 3, wherein a length of the at least one fastener along the second direction is smaller than a length of the middle panel along the second direction.

6. The packing assembly of claim 3, wherein a length of the at least one fastener along the second direction is larger than a length of the middle panel along the second direction so that at least a portion of the fastener is located at the bottom panel.

7. The package assembly of claim 3, wherein a sum length of the at least one fastener along the second direction is smaller than the length of the bottom panel along the second direction.

8. The package assembly of claim 1, wherein the middle panel includes a left end section, a middle section, and a right end section which are foldably connected to the bottom panel along the fold line; and at least one of the left end section or the right end section can be folded inwardly to press the at least one fastener to the bottom panel such that the object can be pre-fixed on the bottom panel before the left side panel and the right side panel are folded outwardly.

9. The package assembly of claim 1, wherein the bottom panel includes at least one limiting panel;

the at least one limiting panel is foldably connected to the bottom panel; and the at least one limiting panel can be folded inwardly to limit movement of the object.

10. The package assembly of claim 1, wherein the at least one fastener includes at least one of a film, a string, or a band.

11. The package assembly of claim 1, wherein the bottom panel includes at least one opening configured to allow a protuberant portion of the object to penetrate the bottom panel.

12. The package assembly of claim 1, the package assembly further comprising a box configured to accommodate the at least one group of side panels, the left side panel, the right side panel, the at least one fastener, and the object.

13. A method for packaging an object using the package assembly of claim 1, the method comprising:

placing an object on a bottom panel of the package assembly;

folding a portion of at least one group of side panels of the package assembly inwardly to make at least one fastener of the package assembly contact with the object; and folding a left side panel and a right side panel outwardly to fasten the at least one fastener on the object.

14. The method of claim 13, wherein the at least one group of side panels includes a first group of side panels and a second group of side panels located at an upper side and a lower side of the bottom panel respectively, wherein the first group of side panels includes a first left end panel, a first middle panel, and a first right end panel which are separately foldable along a first fold line; and the second group of side panels includes a second left end panel, a second middle panel, and a second right end panel which are separately foldable along a second fold line; and the at least one fastener includes a first fastener and a second fastener corresponding to the first group of side panels and the second group of side panels respectively, wherein the first fastener includes a first left end and a first right end fixedly connected to the first left end panel and the first right end panel respectively; and the second fastener includes a second left end and a second right end fixedly connected to the second left end panel and the second right end panel respectively.

15. The method of claim 13, wherein the middle panel includes a left end section, a middle section, and a right end section which are foldably connected to the bottom panel along the fold line; and at least one of the left end section or the right end section can be folded inwardly to press the at least one fastener to the bottom panel such that the object can be pre-fixed on the bottom panel before the left side panel and the right side panel are folded outwardly.

16. The method of claim 13, wherein the bottom panel includes at least one opening configured to allow a protuberant portion of the object to penetrate the bottom panel.

17. The method of claim 13, wherein the bottom panel includes at least one limiting panel;

the at least one limiting panel is foldably connected to the bottom panel; and the at least one limiting panel can be folded inwardly to limit movement of the object.

18. The method of claim 13, wherein a length of the at least one fastener along a first direction is greater than a length of the middle panel or a length of the bottom panel along the first direction.

* * * * *